US005579566A

United States Patent [19]

Burkhardt et al.

[11] Patent Number: 5,579,566

[45] Date of Patent: Dec. 3, 1996

[54] APPARATUS AND METHOD FOR STUFFER BOX CRIMPING SYNTHETIC FILAMENT YARNS

[75] Inventors: Klaus Burkhardt, Schwelm; Klaus Gerhards, Huckeswagen; Winfried Wubken, Remscheid, all of Germany

[73] Assignee: Barmag AG, Remscheid, Germany

[21] Appl. No.: 966,723

[22] Filed: Oct. 26, 1992

[30] Foreign Application Priority Data

Oct. 26, 1991 [DE] Germany ..... 41 35 383.8

[51] Int. Cl.[6] ..... D02G 1/16

[52] U.S. Cl. ..... 28/273; 28/254

[58] Field of Search ..... 28/255, 256, 278, 28/247, 254, 258, 262, 263, 264, 271, 273, 274

[56] References Cited

U.S. PATENT DOCUMENTS

| | | | |
|---|---|---|---|
| 3,281,913 | 11/1966 | Morehead et al. | 28/255 |
| 3,296,677 | 1/1967 | Chase | 28/255 |
| 3,655,862 | 4/1972 | Dorschner et al. | 28/255 |
| 4,315,355 | 2/1982 | Stanley | 28/255 |
| 4,547,938 | 10/1985 | Cullen et al. | 28/272 |
| 4,691,947 | 9/1987 | Burkhardt et al. | 28/255 |
| 4,724,588 | 2/1988 | Runkel | 28/255 |
| 4,796,340 | 1/1989 | Gerhards | 28/272 |
| 4,829,640 | 5/1989 | Greb et al. | 28/272 |
| 4,965,916 | 10/1990 | Artunc et al. | 28/271 |

FOREIGN PATENT DOCUMENTS

| | | |
|---|---|---|
| 7723587 | 1/1979 | Germany . |
| 2753705 | 6/1979 | Germany . |
| 8022113 | 12/1981 | Germany . |
| 1423122 | 1/1976 | United Kingdom . |

*Primary Examiner*—C. D. Crowder
*Assistant Examiner*—Larry D. Worrell, Jr.
*Attorney, Agent, or Firm*—Bell, Seltzer, Park & Gibson, P.A.

[57] ABSTRACT

An apparatus for stuffer box crimping synthetic filament yarns is disclosed, which includes an air nozzle for pulling in and advancing multi-filament yarns at a high speed, and a downstream stuffer box in which the gaseous transport fluid is separated and the yarn is compressed to a compact yarn plug. To increase the production speed and production reliability, the speed at which the yarn is advanced through the air nozzle, and the yarn tension which is produced by the air nozzle is increased. This occurs in accordance with the invention in that the duct for the common advance of the yarn and the transport fluid is configured such that the flow duct narrows in the shape of a nozzle in a first segment down to a restriction at which the outflowing transport fluid reaches the speed of sound, and the duct then widens in a second segment at a small angle of opening.

20 Claims, 4 Drawing Sheets

APPARATUS AND METHOD FOR STUFFER BOX CRIMPING SYNTHETIC FILAMENT YARNS

BACKGROUND OF THE INVENTION

The present invention relates to an apparatus and method for stuffer crimping synthetic filament yarns.

EP-189099-B discloses a known texturizing nozzle wherein the portion of the yarn duct which is located downstream of an initial nozzle portion, and where the yarn is advanced with the pressurized fluid, is constructed with a cylindrical, in particular circular-cylindrical cross section and with a diameter which is constant over its length.

The known texturing nozzle as described above has proven to be effective, particularly in machines for carrying out a continuous spin-draw-texturing process, and it is very successfully employed by the industry for stuffer box crimping synthetic filament yarns of polyester, in particular polyethylene terephthalate, PA6, PA6.6, or PP at draw speeds downstream of the spinning stage ranging from 1800 to 3000 m/min. At this speed, however, a limit of the production speed is reached, inasmuch as the yarn tension in the filament bundle which is advanced by the nozzle, and any slackening of the yarn, lead to the formation of laps on the draw rolls and to instabilities in the production process.

It is accordingly the object of the present invention to improve the construction of the apparatus for stuffer crimping, so that the specified technical upper speed limit for a reliable performance of the stuffer box crimping by the known continuous spin-draw-texturing method may be further increased and wherein at the increased yarn speed, the nozzle still exerts an adequate tension on the advancing yarn.

It is a further object of the present invention to provide an apparatus and method for stuffer crimping having an increased speed capability, and wherein the high quality of prior systems as regards yarn crimping, consistency and disentanglement of the yarn plug, remains unchanged, and that the consumption and pressure of the pressurized fluid are as low and as economical as possible.

SUMMARY OF THE PRESENT INVENTION

The above and other objects and advantages of the present invention are achieved in the embodiments illustrated herein by the provision of a texturizing apparatus and method which comprise a nozzle including a duct through which the yarn is adapted to advance at high speed from an inlet end to an outlet end, passageway means for introducing a pressurized fluid into the duct at a predetermined location along the length of the duct during operation of the apparatus, and a stuffer box disposed adjacent the outlet end of the duct. The stuffer box includes a perforated circumferential wall segment, and it is adapted for receiving the advancing yarn exiting from the duct and forming the same into a yarn plug.

In accordance with the present invention, the duct includes a converging portion located immediately downstream from the predetermined location and wherein the diameter of the duct progressively decreases to a restriction of minimum diameter. A diverging portion extends from the restriction at least substantially to the stuffer box and wherein the diameter of the duct progressively increases.

The apparatus of the present invention permits the entraining current present in the common duct for the multi-filament yarn and the outflowing pressurized fluid to reach the speed of sound, which remains at least unchanged or further increases in the widening portion of the flow duct. As a result, an increased tension is exerted on the yarn, which allows yarn speeds of up to about 4000 m/min. downstream of the draw rolls, and this without an increase of the operating pressure of the pressurized fluid and the therewith connected risk of blowing the yarn plug out of the stuffer box adjacent to the flow duct.

DE-27 53 705 and DE-17 85 158 disclose a stuffer box crimping apparatus with an air nozzle in which the outflowing pressurized fluid reaches supersonic speed in the widening duct. However, in this apparatus, the flow duct is suddenly enlarged in its cross section at the point where the flow of the pressurized fluid impacts on the advancing yarn, and the duct remains unchanged in cross section up to the stuffer box. Apart from the fact that the nozzle is operated at substantially higher pressures up to 40 bar, in the examples 14 to 15 bar, the supersonic flow collapses because of the considerable widening of the flow duct and the therein occurring compression shock, and the entraining action on the yarn decreases significantly. As a result of the high operating pressure of the pressurized fluid there is also the risk that the yarn plug is blown out of the stuffer box and that a crater develops while the yarn plug is being formed, which may also result in an unsatisfactory disentanglement.

Tests with the initially described texturing nozzle have shown that in ducts with a constant diameter and a small diameter, it is possible to maintain a supersonic flow only over a very short length. However, it has been found that a small angle of widening adapted to the frictional conditions in the duct allows a supersonic flow over a longer distance.

Although it is possible to have the flow duct terminate by a suddenly increased cross section in the stuffer box, it is preferred to provide a transition between the duct and the preferably circular-cylindrical, or slightly conically widening stuffer box which is in the form of a short separate conical segment which has a considerably enlarged included angle. As a result, the flow widens in this region gradually to the cross section of the stuffer box, in which a radial component of force is operative on the yarn. This also results in a more uniform deposit of the yarn over the entire cross section of the stuffer box, thereby successfully counteracting the development of a crater in the newly formed yarn plug.

It should be pointed out that a clear distinction is to be made between the last-described conical segment of the nozzle upstream of the stuffer box as regards its length and shape of the widening, and the portion of the duct in which the pressurized fluid and the yarn impact upon one another, and in which frictional forces cause the large forces of the flow to be transmitted to the yarn. Advantageously, the flow duct has a length greater than 30 times, preferably more than 40 times, the cross sectional diameter of the duct at the restriction. This allows the forces to be transmitted onto the yarn over a great length, in which the outflowing pressurized fluid has supersonic speed. As a result of the impulse transmission from the entraining current surrounding the yarn, the latter reaches a very high speed of advance, for example, when it is freely withdrawn from a feed yarn package, or when the yarn speed is limited by the delivery speed of the draw roll, the nozzle produces a high yarn tension.

The included angle of opening (alpha) of the flow duct immediately downstream of the restriction is preferably less than 3°, and most preferably is between 1° and 2°. The advantage of this very small angle of opening in the flow duct lies in that with a very narrow cross section of the flow duct and the wall friction which is necessary to be considered, the supersonic speed itself is maintained without stalling the flow even at a great overall length of the duct. This means that it is possible to prevent a compression shock from developing in the flow in an advantageous manner. Impulse and energy are transmitted to the yarn with a particularly high efficiency.

In one embodiment, the segment of the flow duct immediately downstream of the restriction first widens to a relatively large extent in a first portion, and then widens to a lesser extent in a second portion. This configuration has the advantage that after reaching the speed of sound in the restriction, the outflowing pressurized fluid is accelerated to a still greater extent. Preferably, this acceleration proceeds to an optimum which is at a Mach number of 1.4. The second portion of the flow duct is configured such that the flow speed is maintained substantially constant. This allows to obtain over a short distance the desired supersonic speed which is maintained in the adjacent, less divergent second segment without the occurrence of one or several compression shocks.

Preferably, the second portion as described above is at least five times, and preferably more than eight times as long as the first segment. Also, the diameter of the restriction in the flow duct is preferably less than about 3 mm. This sizing results in a limited and economical consumption of the pressurized fluid for the attainable yarn speed.

In the preferred embodiment, the nozzle comprises an upper nozzle portion and a coaxially mounted lower nozzle portion, and the fluid passageway opens into the bore at the downstream end of the upper nozzle portion. This configuration has the advantage of a better and easier adaptation of the air flow duct for purposes of adjusting the yarn tension.

The upper nozzle portion includes a lower end portion of truncated conical configuration, and the lower nozzle portion includes a conical recess coaxially communicating with the bore. Also, the conical recess receives the lower end portion of the upper nozzle portion so as to define an annular slot therebetween which forms the outlet of the fluid passageway. This permits the nozzle to be constructed, maintained, and particularly cleaned of yarn remnants in a simple manner. A further advantage lies in the fact that the flow from the annular slot which is formed between the frustum of the upper nozzle portion and the recess in the bore has a radial component and that it closely surrounds the yarn on all sides downstream of the convergence of the yarn duct and the fluid passageway.

The upper nozzle portion is preferably axially adjustable with respect to the lower nozzle portion so as to permit adjustment of the size of the annular slot. Also, the upper nozzle portion is sealably connected to the lower nozzle portion by means of a sealing thread and, if need be, with interposed spacers (note, for example, German Utility Models DE-U 80 22 113 and DE-U 77 23 587). This arrangement allows the cross section of the annular slot for the exiting pressurized fluid to be adjusted by changing the relative axial adjustment of the upper and lower nozzle portions. It is further possible by varying the included angles of the recess in the lower nozzle portion and the truncated cone of the upper nozzle portion, to accomplish in combination with the axial adjustability of the upper and lower nozzle portions that the narrowest point of the flow slot therebetween is axially displaced, and that the pressure conditions at the inlet end of the flow channel can be adjusted such that the air nozzle sucks the filament yarns in at the entry of the yarn inlet duct, or that the air nozzle blows out small quantities of the pressurized fluid through the yarn inlet duct. In one embodiment of the nozzle, the latter is advantageously configured such that it can be switched by axial displacement of the upper nozzle portion from a suction operation when the filaments are threaded, to an operating condition with the nozzle slightly blowing out the pressurized fluid at the yarn inlet duct.

The nozzle is preferably constructed of two sections which are laterally movable with respect to each other between a closed operating position and an opened thread-up position. This renders it simple to insert the filament yarns into the air nozzle, which is necessary, in particular at the startup of the texturing apparatus and after a yarn break on the draw rolls, or after a change of spinning nozzles, etc., and which considerably reduces handling times.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
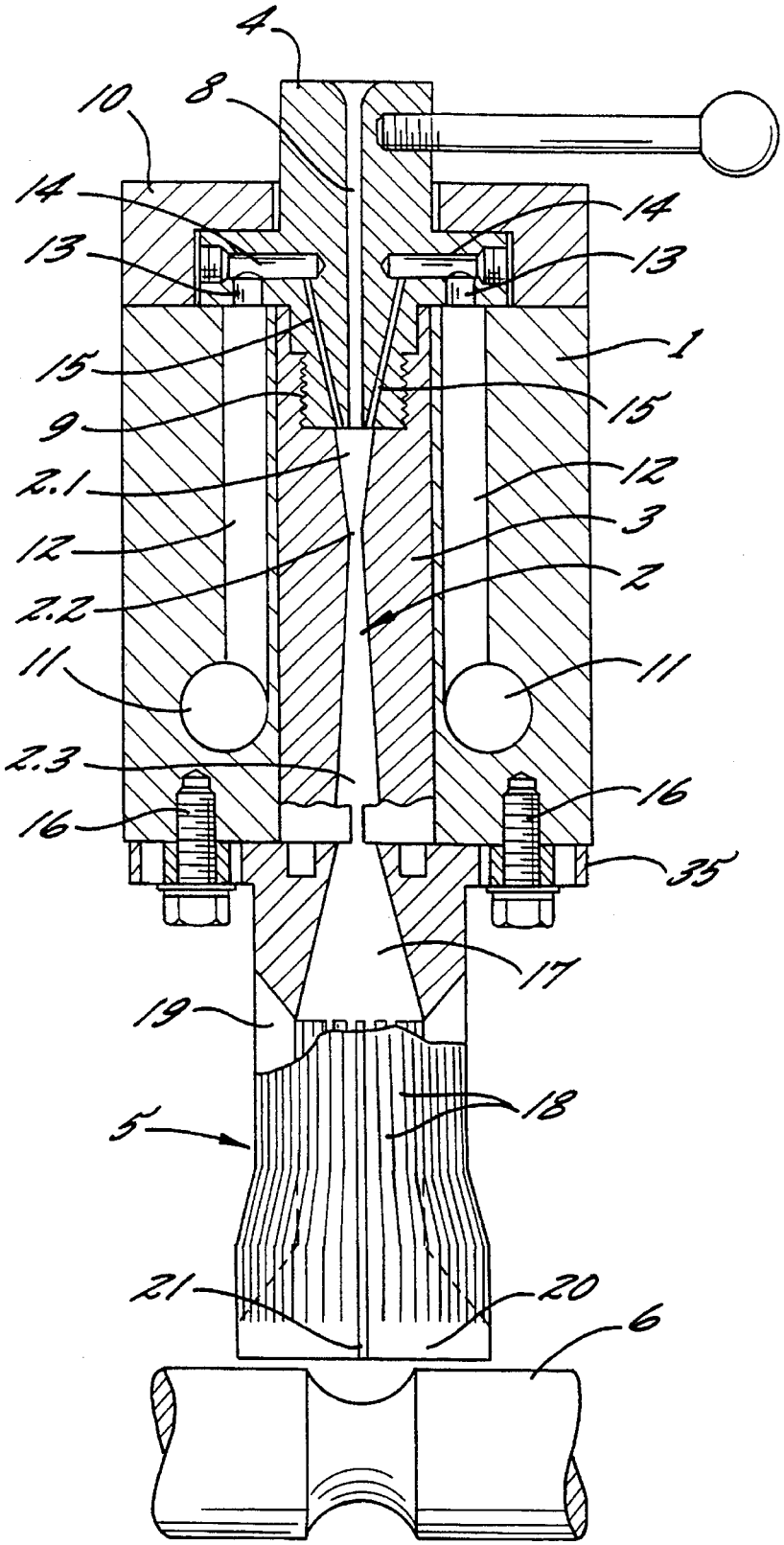
FIG. 1 is a longitudinal sectional view of an air nozzle with adjacent stuffer box and which embodies the present invention.

Referring more particularly to the drawings, FIG. 1 illustrates a stuffer box crimping apparatus, which in its essential parts is substantially identical with the apparatus known from EP-189099-B (FIGS. 17 and 19, respectively). The apparatus comprises a nozzle body 1 which mounts a lower nozzle portion 3 containing a flow duct 2, as well as an upper nozzle portion 4 having a yarn inlet duct 8 which is coaxial with duct 2, and passages for the supply of pressurized fluid as further described below. The portion 4 is threaded with a fine thread 9 into the lower nozzle portion 3 for axial adjustment and sealed by a cover 10 against the losses of pressurized fluid. The pressurized fluid, for example heated compressed air, water vapor, preferably super-heated vapor, is supplied under a pressure of about 7–12 bar through distributor channel 11 in nozzle body 1. Distributor channel 11 is connected via axial ducts 12, annular groove 13 in cover 10, and radial bores 14 with inclined air channels 15 which terminate at the downstream end of upper nozzle portion 4 in channel 2 for the common flow of pressurized fluid and the multi-filament yarn.

The flow channel 2 comprises a first segment 2.1 which narrows to a narrowest cross section or restriction 2.2 in the shape of a nozzle and then it widens again conically in a second segment 2.3 and at a small included angle of opening, which is preferably smaller than 2.0°.

A stuffer box 5 is connected to the bottom of the nozzle body 1 by a flange 35 and screws 16. On its inlet side, the stuffer box 5 comprises a first conical segment 17 having the cross section of flow channel 2 and merging into the circular cylindrical or slightly conical cross section of stuffer box 5. The included angle of the conical segment 17 amounts preferably to about 10°. In the direction of flow, a region follows which is permeable in radial direction, so that the pressurized fluid can be separated from the multi-filament yarn in stuffer box 5. This region comprises narrowly spaced ribs 18 which are formed by slots 19 in wall 20 of the stuffer box, and are in such a close vicinity of one another that portions of the formed yarn plug do not get caught on ribs 18. The outlet end of stuffer box 5 is shaped circular-cylindrically or slightly conically to form a yarn plug 7 of circular cross section. Arranged opposite the outlet end is a delivery roll 6 having a profiled cross section and which is driven by an infinitely variable drive which cooperates with a second roll not shown. Over its entire length, the apparatus is provided with a threading slot 21 which can be opened by means (not shown) for threading the filament yarns, and be closed in operation so that individual filaments cannot be blown out of slot 21. As regards further details, reference is made to the above-cited EP-189099-B.

Figure 2:
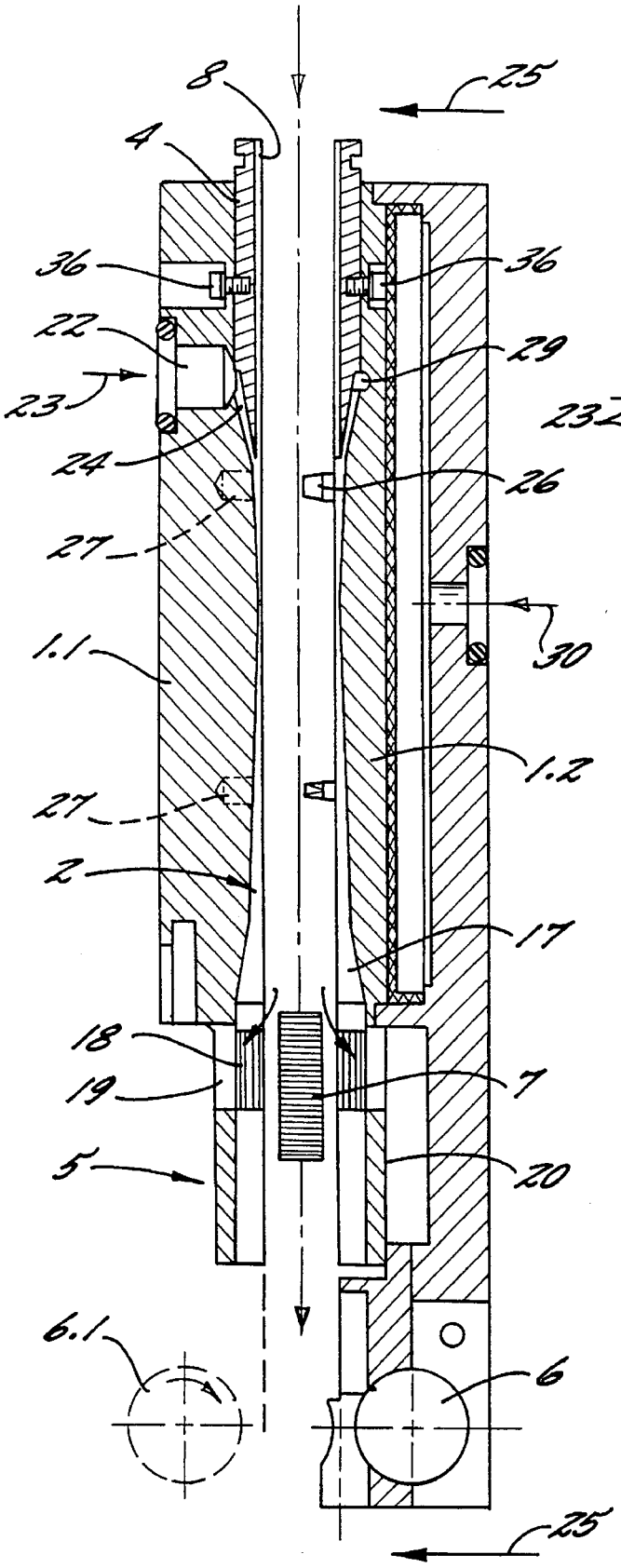
FIG. 2 is a sectional view of a modified embodiment of a stuffer box crimping apparatus in accordance with the invention, which is divided in the longitudinal direction.

FIG. 2 shows a modified stuffer box crimping apparatus in its opened condition. Structural parts having the same function as in FIG. 1 are provided with the same reference numerals. In this embodiment, the longitudinally divided upper nozzle portion 4 is attached to nozzle body 1 by means of screws 36. The pressurized fluid which is supplied through a radial channel 22 in nozzle body 1 in direction of arrow 23, flows through a conical annular slot 24 into flow channel 2 and impacts there on the yarn advancing through yarn inlet duct 8. The yarn is then compressed in stuffer box 5 to form a yarn plug 7, and the plug is removed by delivery roll 6 and roll 6.1.

For cleaning or threading the filament yarn, the stuffer box crimping apparatus as shown in FIG. 2 is divided in longitudinal direction in two halves 1.1 and 1.2, and its one half 1.2 is moved in direction of arrow 25 for closing, with centering cams 26 on the one nozzle half 1.2 engaging with associated centering bores 27 on the other nozzle half 1.1 and actuating locking means not shown in detail. When the pressure chamber 28 is pressurized with the pressurized fluid entering at 30, the two nozzle halves 1.1, 1.2 are pressed together, sealed in the longitudinal direction, and a radial outflow of the operating fluid is prevented.

Figure 3:
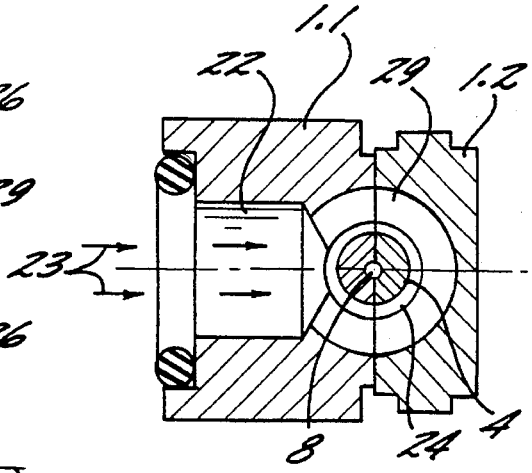
FIG. 3 is a cross sectional view of the nozzle of FIG. 2 in the region of the pressurized fluid supply.

FIG. 3 is a cross sectional view of the stuffer box crimping apparatus in the region of pressurized fluid supply 22 and annular chamber 29, which terminates in annular slot 24 on the outer circumference of the lower end portion of the upper nozzle portion 4.

Figure 4:
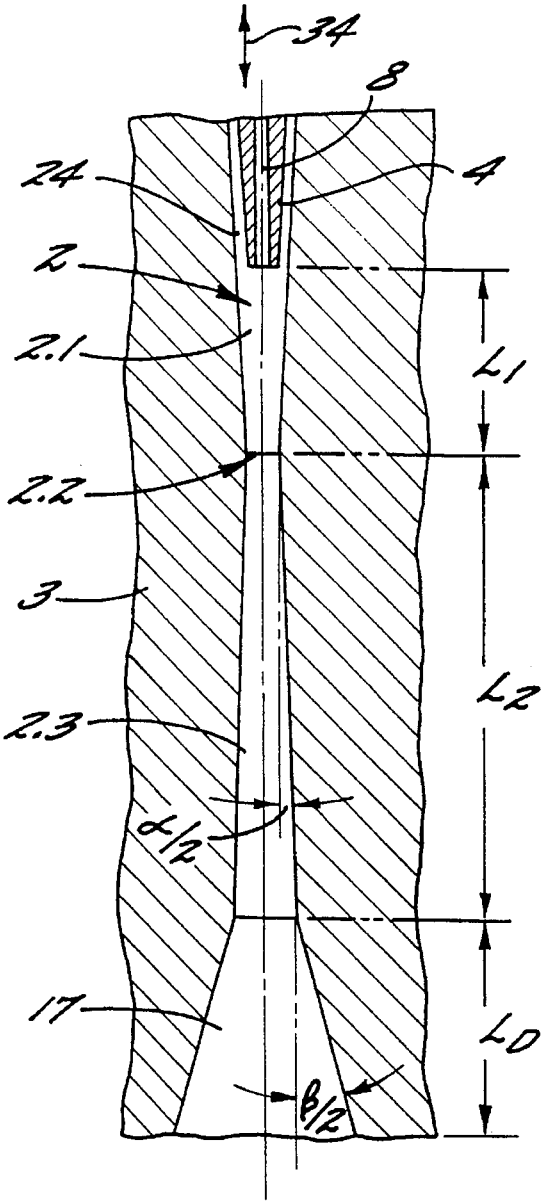
FIGS. 4 and 4A are enlarged fragmentary sectional views of two different configurations of the flow duct for the passage of the yarn and the pressurized fluid.

FIG. 4 is an enlarged view of the flow duct 2 in lower nozzle portion 3 of nozzle body 1 of the stuffer box crimping apparatus. The duct 2 first narrows in a first segment 2.1 of length $L_1$, down to a restriction 2.2, at which the duct has its narrowest cross section, and the flow reaches the speed of sound. The lower end portion of the upper nozzle portion 4 extends axially into the first segment 2.1, and is axially adjustable in direction of arrow 34. The multi-filament yarn advances through concentric duct 8, and the pressurized fluid is supplied through the conically narrowing annular slot 24 which is formed between the lower end portion of the upper nozzle portion 4 and the bore of the lower nozzle portion 3. Downstream of the restriction 2.2, the cross section of flow duct 2 increases in segment 2.3 which has a length $L_2$. In the embodiment illustrated in FIG. 4, the segment 2.3 increases in width continuously and uniformly over its length, at an included angle alpha of less than 5°, preferably less than 3°, and most preferably between 1° and 2°. The size of the angle of widening alpha is basically also dependent on the quality of the mechanical machining of the duct wall, and in the event of inferior workmanship of flow duct 2 is made with a larger included angle.

The length $L_2$ of flow duct segment 2.3 is dimensioned in dependence on the diameter of flow duct 2 at the restriction 2.2. At a diameter of less than 3 mm at the restriction 2.2, a length $L_2$ between 30 and 40 times this diameter, and an initial pressure of the pressurized fluid of about 6 bar, provides the most favorable results with respect to attainable yarn speed and texturing. With a higher initial pressure of the fluid, still greater lengths $L_2$ will be of advantage to obtain still higher yarn tensions.

Figure 4A:
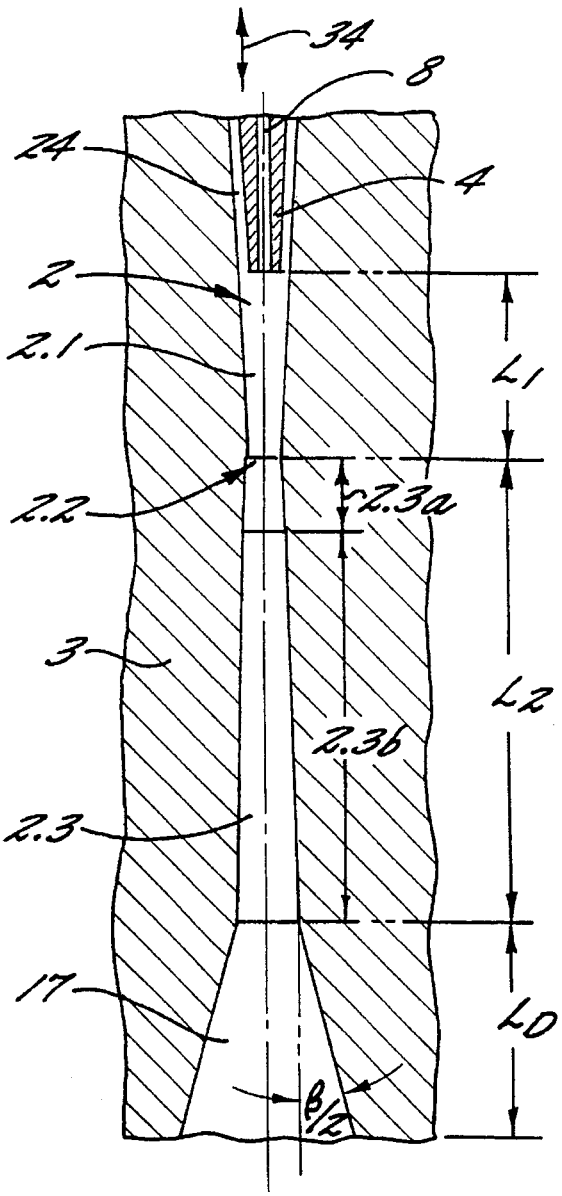

FIG. 4A illustrates a further embodiment, wherein the length $L_2$ of the segment 2.3 widens in two stages, namely a first portion **2.3*a* adjacent the restriction 2.2 which has a relatively large widening angle and a second portion 2.3*b* having a somewhat smaller widening angle. The length of the portion 2.3*b* with the smaller widening angle, is preferably more than eight times as long as the length of the first portion 2.3*a*** with the greater widening angle.

The last segment of the flow duct is the final segment 17 having a length $L_D$, and a clearly greater included angle beta, with beta being less than 20°, and preferably between about 5° to 15°. After the occurrence of smaller compression shocks, a subsonic flow passes through this segment.

Since in this region of the duct the yarn has almost reached stuffer box 5, the drop of speed at this point plays no longer a significant role. The length $L_D$ of this final segment results from the diameter of flow duct 2.3, at its end, from angle beta and the diameter provided for stuffer box 5.

Figure 5:
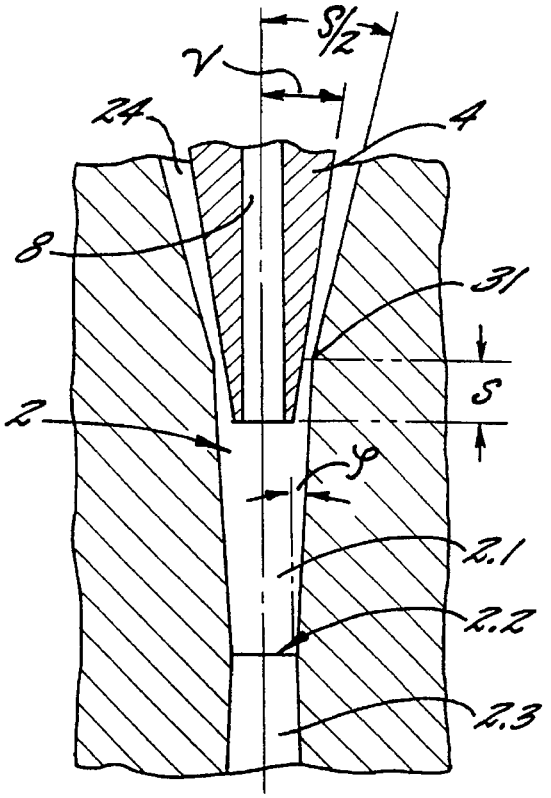
FIGS. 5 and 6 are enlarged fragmentary sectional views of two different configurations of the flow duct in the region of the downstream end of the upper nozzle portion.
Figure 6:
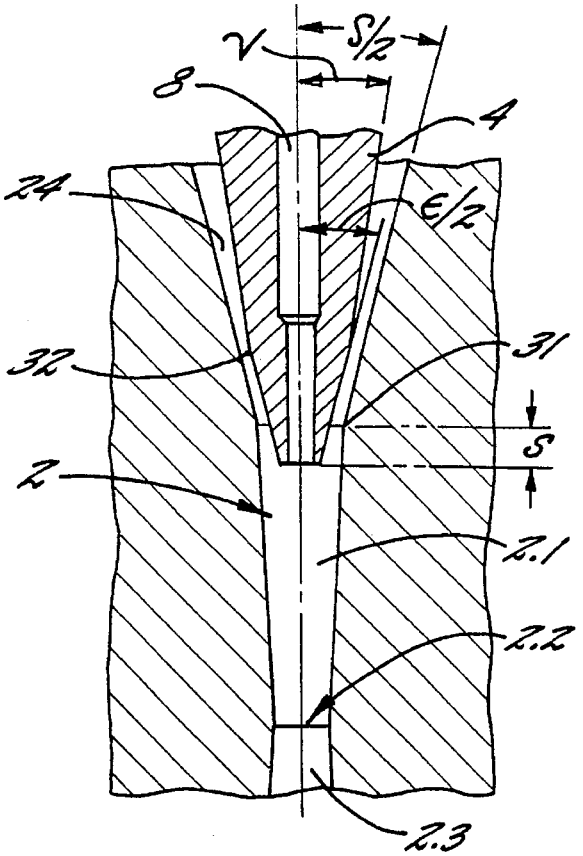

Shown in FIGS. 5 and 6 is the flow duct 2 in the region of the lower end portion of the upper nozzle portion 4. In FIG. 5, the annular slot 24 conically extends in nozzle body 1 and forms an included angle rho. At point 31 it merges into the segment 2.1 of flow duct 2 which narrows in the shape of a nozzle and has its narrowest cross section of flow at point 2.2. The lower end portion of the upper nozzle portion 4 is formed at an included angle gamma which deviates from, and is smaller than the included angle rho in nozzle body 1. This permits the nozzle portion 4 to be axially displaced by a length s beyond the point 31 into the flow duct. It is therefore possible to place the narrowest cross section of annular slot 24 upstream of the downstream end of nozzle portion 4 at the point 31. This allows an influence to be exerted on whether and in which quantities the pressurized fluid exits upstream through yarn inlet duct 8 of the upper nozzle portion 4.

In FIG. 6, the upper nozzle portion 4 is configured in a modification of the conditions of FIG. 5 such that its surface is formed by two conical surfaces, of which the upstream surface has an included angle gamma whereas the downstream surface has an included angle epsilon. The fact that the surface of the upper nozzle portion 4 is composed of two conical surfaces coinciding on circumference 32 with differing included angles, allows the annular slot 24 and the pressure conditions in annular slot 24 and in yarn inlet duct 8 to be influenced such that the air nozzle does not blow backward.

In the drawings and specification, there has been set forth a preferred embodiment of the invention, and although specific terms are employed, they are used in a generic and descriptive sense only and not for purposes of limitation.

That which is claimed is:

1. An apparatus for texturizing an advancing yarn with a pressurized fluid such as hot air, and comprising a nozzle including a duct which includes an inlet end and an outlet end and through which the yarn advances at high speed from said inlet end to said outlet end, passageway means for introducing a pressurized fluid into the duct at a predetermined location along the length of the duct and into direct engagement with the advancing yarn during operation of the apparatus, and a stuffer box including a perforated circumferential wall segment and with said stuffer box being disposed adjacent the outlet end of the duct for receiving the advancing yarn exiting from the duct and forming the same into a yarn plug, the duct including a converging portion located immediately downstream from the predetermined location and wherein the diameter of the duct decreases to a restriction of minimum diameter, and a diverging portion which extends from the restriction at least substantially to the stuffer box and wherein the diameter of the duct increases, with said diverging portion having an included angle of divergence and a length which are configured and dimensioned to permit the pressurized fluid to reach the speed of sound at the restriction.

2. The apparatus as defined in claim 1 wherein said diverging portion of said duct includes a conical first segment immediately downstream of said restriction which defines a first angle of divergence, and a conical second segment immediately adjacent said stuffer box which defines a second angle of divergence which is larger than said first angle of divergence.

3. The apparatus as defined in claim 2 wherein said second segment has an angle of divergence which is less than about 20 degrees.

4. The apparatus as defined in claim 1 wherein said diverging portion of said duct includes a conical segment immediately downstream of said restriction which has a uniform angle of divergence which is less than about 3 degrees.

5. The apparatus as defined in claim 1 wherein said diverging portion of said duct includes a segment immediately downstream of said restriction which comprises a conical first portion adjacent said restriction which defines a first widening angle and a conical second portion which defines a second widening angle which is less than said first widening angle.

6. The apparatus as defined in claim 5 wherein said second portion is at least five times as long as said first portion.

7. The apparatus as defined in claim 1 wherein the length of said duct downstream of said predetermined location equals more than about 30 times the diameter at said restriction.

8. The apparatus as defined in claim 1 wherein the diameter of said duct at said restriction is less than about 3 mm, wherein said diverging portion of said duct has an angle of divergence which is less than about 3 degrees, and wherein the length of said diverging portion of said duct is more than about 30 times the diameter at said restriction.

9. The apparatus as defined in claim 1 wherein said nozzle comprises an upper nozzle portion and a lower nozzle portion which is coaxially mounted with respect to said upper nozzle portion, and wherein said passageway means opens into said duct at the downstream end of said upper nozzle portion.

10. The apparatus as defined in claim 9 wherein said upper nozzle portion includes a transverse lower end, and wherein said passageway means communicates with said transverse lower end.

11. The apparatus as defined in claim 9 wherein said upper nozzle portion includes a lower end portion of truncated conical configuration, and said lower nozzle portion includes a conical recess coaxially communicating with said duct and receiving said lower end portion, and so as to define an annular slot therebetween which forms the outlet of said passageway means.

12. The apparatus as defined in claim 11 further comprising means mounting said upper nozzle portion to said lower nozzle portion so that said upper nozzle portion is axially adjustable with respect to said lower nozzle portion so as to permit adjustment of the size of the annular slot.

13. The apparatus as defined in claim 11 wherein said conical recess of said lower nozzle portion defines an included angle (rho) and said lower end portion of said upper nozzle portion defines an included angle (gamma), and said included angle (rho) is greater than said included angle (gamma).

14. The apparatus as defined in claim 11 wherein said lower end portion of said upper nozzle portion includes a rear conical surface and a forward conical surface when viewed in the direction of flow, and wherein said rear conical surface defines an included angle (gamma) which is less than the included angle (epsilon) defined by said forward conical surface.

15. The apparatus as defined in claim 11 wherein said converging portion of said duct which is immediately downstream of said predetermined location communicates with said recess, and the lower end portion of said upper nozzle portion includes a transverse lower end, and said lower end portion projects into said converging portion of said duct and such that the most narrow portion of said annular slot is upstream of said lower end of said upper nozzle portion.

16. The apparatus as defined in claim 1 wherein said nozzle comprises two sections and means mounting said two sections to each other so that said two sections are movable with respect to each other and so as to define an operating position of said nozzle wherein said duct is laterally closed, and a non-operating position of said nozzle wherein said duct is laterally open to facilitate insertion of a yarn into said duct.

17. A method for texturizing an advancing yarn with a pressurized heating fluid, and comprising the steps of providing a nozzle including a duct through which the yarn is adapted to advance at high speed from an inlet end to an outlet end, passageway means for introducing a pressurized heating fluid into said duct and into direct engagement with the advancing yarn at a predetermined location along the length of said duct during operation of said apparatus, and a stuffer box including a perforated circumferential wall segment and being disposed adjacent said outlet end of said duct for receiving the advancing yarn exiting from said duct and forming the same into a yarn plug, with said duct including a converging portion located immediately downstream from said predetermined location and wherein the diameter of said duct progressively decreases to a restriction of minimum diameter, and a diverging portion which extends from said restriction at least substantially to said stuffer box and wherein the diameter of said duct progressively increases, and guiding an advancing yarn through said duct from said inlet end to said outlet end and into and through said stuffer box, and while introducing a pressurized heating fluid through said passageway means and into said duct and into direct engagement with the advancing yarn at said predetermined location under conditions such that the fluid reaches the speed of sound at said restriction.

18. The method as defined in claim 17 wherein said pressurized heating fluid is selected from the group consisting of hot air and super-heated vapor.

19. The method as defined in claim 18 wherein said advancing yarn is composed of a plurality of synthetic filaments.

20. The method as defined in claim 19 wherein said yarn is advanced through said nozzle at a speed of at least about 3000 m/min.

* * * * *